US006182013B1

(12) United States Patent
Malinverno et al.

(10) Patent No.: US 6,182,013 B1
(45) Date of Patent: Jan. 30, 2001

(54) METHODS AND APPARATUS FOR DYNAMICALLY ESTIMATING THE LOCATION OF AN OIL-WATER INTERFACE IN A PETROLEUM RESERVOIR

(75) Inventors: Alberto Malinverno, Blauvelt, NY (US); David J. Rossi, Katy, TX (US); Metin Karakas, Amstelveen (NL); Brian Spies, Roseville (AU); Carlos Torres-Verdin, Buenos Aires (AR); Ian Bryant, Ridgefield; Min-Yi Chen, West Redding, both of CT (US)

(73) Assignee: Schlumberger Technology Corporation, Ridgefield, CT (US)

( * ) Notice: Under 35 U.S.C. 154(b), the term of this patent shall be extended for 0 days.

(21) Appl. No.: 09/361,031

(22) Filed: Jul. 23, 1999

(51) Int. Cl.[7] ..... G01V 1/50
(52) U.S. Cl. ..... 702/7
(58) Field of Search ..... 702/7, 12, 13; 324/330, 339

(56) References Cited

U.S. PATENT DOCUMENTS

| | | | |
|---|---|---|---|
| 5,467,823 | 11/1995 | Babour et al. | 166/250.01 |
| 5,642,051 | 6/1997 | Babour et al. | 324/357 |
| 5,767,680 | 6/1998 | Torres-Verdin et al. | 324/355 |

OTHER PUBLICATIONS

Abbaszadeh, M. and Kamal, M. *Pressure–transient Testing of Water–Injection Wells.* SPE Reservoir Engineering (Feb. 1989) pp. 115–124.

Adolph, B. et al. *Saturation Monitoring With the RST Reservoir Saturation Tool.* Oilfield Review, 6 (Jan. 1994) pp. 29–39.

Bard, Yonathan. *Nonlinear Parameter Estimation.* Academic Press, New York. (1974) Chapter V, Computation of the Estimates I: Unconstrained Problems. pp. 83–140.

Ellis, Darwin V. *Well Logging for Earth Scientists.* Elsevier, New York. (1987) Chapter 20, Saturation Estimation. pp. 471–489.

Jazwinski, Andrew H. *Stochastic Processes and Filtering Theory.* Academic Press, New York (1970) Chapter 8, Applications of Linear Theory. pp. 266–281.

Ramakrishnan, T. S. and Kuchuk, F. J. *Pressure Transients During Injection: Constant Rate and Convolution Solutions.* Transport in Porous Media, 10 (1993) pp. 103–136.

Ramakrishnan, T.S. and Kuchuk, F.J. *Testing Injection Wells with Rate and Pressure Data.* SPE Formation Evaluation (Sep. 1994) pp. 228–236.

(List continued on next page.)

*Primary Examiner*—Donald E. McElheny, Jr.
(74) *Attorney, Agent, or Firm*—William B. Batzer; David P. Gordon

(57) ABSTRACT

Methods for locating an oil-water interface in a petroleum reservoir include taking resistivity and pressure measurements over time and interpreting the measurements. The apparatus of the invention includes sensors preferably arranged as distributed arrays. According to a first method, resistivity and pressure measurements are acquired simultaneously during a fall-off test. Resistivity measurements are used to estimate the radius of the water flood front around the injector well based on known local characteristics. The flood front radius and fall-off pressure measurements are used to estimate the mobility ratio. According to a second method, resistivity and pressure measurements are acquired at a variety of times. Prior knowledge about reservoir parameters is quantified in a probability density function (pdf). Applying Bayes' Theorem, prior pdfs are combined with measurement results to obtain posterior pdfs which quantify the accuracy of additional information. As new measurements are acquired, posterior pdfs, updated for expected temporal variations, become prior pdfs for the new measurements. According to a third method, uncertainty about the reservoir parameters is represented by Gaussian pdfs. The relationship between measurements and reservoir parameters is locally approximated by a linear function. Uncertainties are quantified by a posterior covariance matrix.

19 Claims, 6 Drawing Sheets

OTHER PUBLICATIONS

Ramirez, A. and Daily, W. *Monitoring an Underground Steam Injection Process Using Electrical Resistance Tomography.* Water Resources Research, vol. 29, No. 1. (Jan. 1993) pp. 73–87.

Sabet, M.A. *Well Test Analysis.* Contributions in Petroleum Geology and Engineering, vol. 8. Gulf Publishing Company, Houston. (1991) pp. 1–23.

Unneland, T. and Haugland. T. *Permanent Downhole Gauges Used in Reservoir Management of Complex North Sea Oil Fields.* SPE 26781, Offshore European Conference, Aberdeen (Sep. 7–10, 1993), pp. 293–302.

Wilt, Michael, et al. *Crosshole Electromagnetic Tomography: A New Technology for Oil Field Characterization.* The Leading Edge, 14, 3 (1995) pp. 173–177.

METHODS AND APPARATUS FOR DYNAMICALLY ESTIMATING THE LOCATION OF AN OIL-WATER INTERFACE IN A PETROLEUM RESERVOIR

This application is related to co-owned U.S. Pat. No. 5,467,823, co-owned U.S. Pat. No. 5,642,051, and co-owned U.S. Pat. No. 5,767,680, the complete disclosures of which are hereby incorporated herein by reference.

BACKGROUND OF THE INVENTION

1. Field of the Invention

The invention relates to the management of hydrocarbon producing wells. More particularly, the invention relates to methods and apparatus for dynamically mapping the location of an oil-water interface and for predicting reservoir fluid movement and pressures under different production conditions.

2. State of the Art

In a petroleum reservoir, oil is produced through a well under pressure of gas, water, or compaction. Water may be naturally present in the reservoir displacing the oil to urge it out through the well bore. Often, water is injected into the reservoir from an injection bore located near the production bore. As oil is extracted from the well, the water moves through the porous medium of the formation closer to the well and the oil-water interface changes shape. If the location of the oil-water interface is not monitored during production, it is possible that the well will produce a mixture of oil and water. In some cases, it is possible for the well to produce more water than oil.

Well logs are a primary source of information used to map the distribution of fluids in hydrocarbon reservoirs. Because of the high electrical resistivity of hydrocarbons compared to formation water, open hole well logs of resistivity are typically used to infer water saturation, the percentage of pore volume occupied by water. As wells are typically cased with conductive steel pipe after drilling, it is not usually possible to take resistivity measurements through the casing. If a non-conductive casing is used, crosshole tomography techniques can be used to map the distribution of electrical resistivity in the reservoir volume. Measurement of fluid pressures is also used to estimate multiphase fluid flow properties (e.g. water and oil mobilities) and the location of the oil-water interface.

Previously incorporated U.S. Pat. No. 5,467,823 and U.S. Pat. No. 5,642,051 disclose methods and apparatus for monitoring a production reservoir with pressure and resistivity sensors which are permanently mounted in the production well between the casing and the borehole. The '823 patent does not specifically address the issue of monitoring the location of the oil-water interface and neither patent discloses any method for interpreting data acquired by the sensors in order to predict the location of the oil-water interface over time.

Previously incorporated U.S. Pat. No. 5,767,680 discloses a method for sensing and estimating the shape and location of oil-water interfaces in a formation traversed by a well. The method includes making time-lapse DC/AC measurements with an array of permanently deployed sensors in order to detect and estimate the change in geometry and proximity of the oil-water interface as a result of production, and therefore as a function of time. The estimation is carried out with a parametric inversion technique whereby the shape of the oil-water interface is assumed to take the form of a three-dimensional surface describable with only a few unknown parameters. A nonlinear optimization technique is used to search for the unknown parameters such that the differences between the measured data and the numerically simulated data are minimized in a least-squares fashion with concomitant hard bound physical constraints on the unknowns. The estimation procedure is robust in the presence of relatively high levels of noise and can therefore be used to anticipate deleterious water breakthroughs, as well as improve the efficiency with which the oil is produced from the reservoir.

The fundamental challenge posed in interpreting reservoir property measurements is to optimize each measurement of reservoir properties at time t by using all of the measurements acquired up until time t. This is difficult because the relationship between measurements and reservoir properties is generally complex and because measurement errors will affect subsequent interpretations of reservoir properties.

SUMMARY OF THE INVENTION

It is therefore an object of the invention to provide methods for interpreting measurements made in a producing hydrocarbon reservoir to estimate the distribution of fluids and the multiphase flow properties of the reservoir.

It is also an object of the invention to provide methods for estimating the location of the oil-water interface in a producing hydrocarbon reservoir.

It is another object of the invention to provide methods for optimizing reservoir property measurements with prior information and previously acquired measurements.

It is still another object of the invention to provide apparatus for performing the methods of the invention.

In accord with these objects which will be discussed in detail below, the methods of the present invention include taking resistivity and pressure measurements in a producing hydrocarbon reservoir over time and interpreting the measurements to determine the distribution of fluids and the multiphase flow properties of the reservoir and the location of the oil-water interface. The measurement sensors may be located in the injecting well, in the production well, or in a dedicated monitoring well. The pressure measurements may be of fluid pressure in a well or pore pressure in the formation. The resistivity measurements may be DC potential measurements made with electrodes or AC electromagnetic measurements made with antennae. According to a preferred aspect of the invention, the sensors are arranged as distributed arrays and water injection is periodically interrupted while fall-off pressure and resistivity are monitored.

The pressure and resistivity measurements may be interpreted in several ways. Preferably, for each estimate made in the interpretation of a data set, a measure of the accuracy of the estimate is also made. Estimates and their "uncertainties" are then used to compute forecasts of reservoir performance and the uncertainties of the forecasts. The forecasts allow the oil field operator to optimize reservoir production by varying the injection/production rates to minimize or eliminate water production.

According to a first method, resistivity and pressure measurements are acquired simultaneously at an observation well during a fall-off test. Resistivity measurements are used to estimate the radius of the water flood front around the injector well based on known local characteristics. The flood front radius and fall-off pressure measurements are used to estimate the mobility ratio. According to a second method, resistivity and pressure measurements are acquired at a variety of times at an observation well and pressure measurements are taken during fall-off tests. Prior to taking any measurements, knowledge about the reservoir parameters is quantified in a prior probability density function (pdf). Applying Bayes' Theorem, the prior pdf is combined with measurement results to obtain a posterior pdf which quantifies the accuracy of the additional information. As new measurements are acquired, posterior pdfs, updated for expected temporal variations, become prior pdfs for the new measurements. According to a third method, uncertainty about the reservoir parameters is represented by Gaussian pdfs. The relationship between measurements and reservoir parameters is approximated by a linear function. Uncertainties are quantified by a posterior covariance matrix.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
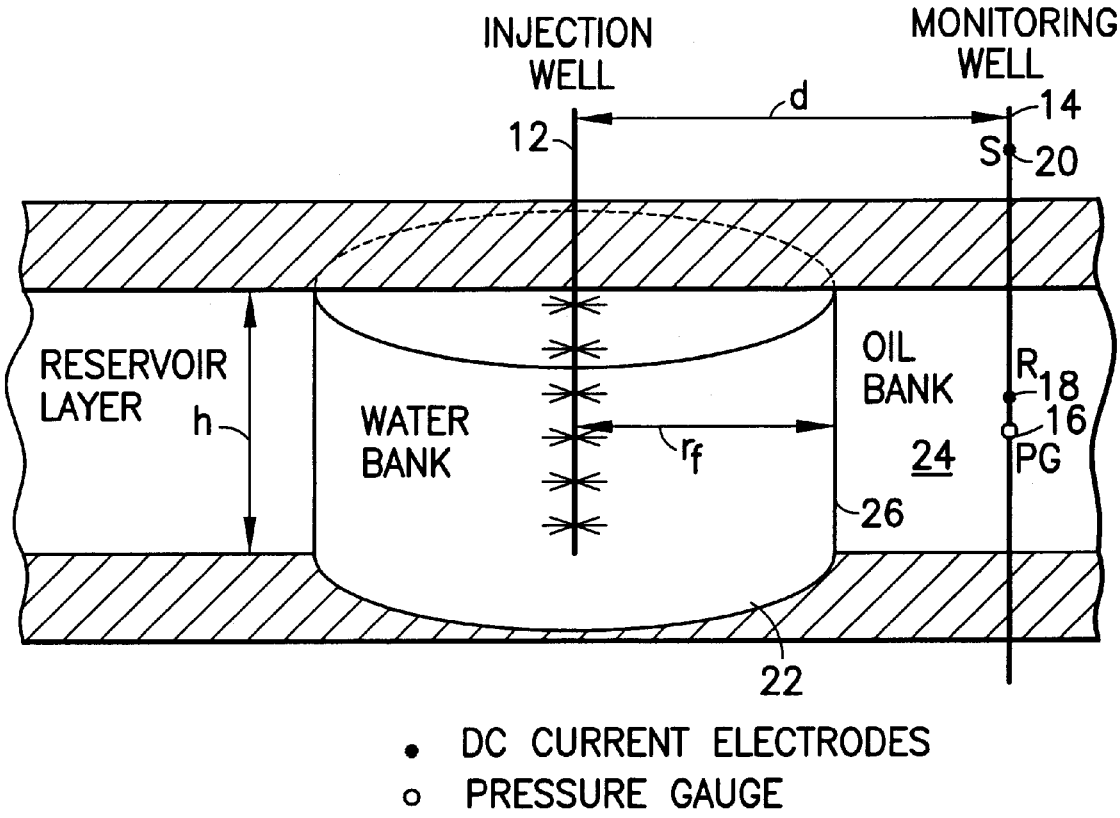
FIG. 1 is a schematic diagram of an injection well and a monitoring well in a single-layer reservoir undergoing water injection.

Referring now to FIG. 1, a first method according to the invention is illustrated with reference to a single layer oil reservoir which is injected with water via an injection well 12 so as to force oil into a production well (not shown). A monitoring well 14 is located a known distance "d" from the injection well 12. The monitoring well 14 is provided with a pressure gauge 16 (for monitoring pore pressure) and a DC resistivity electrode 18. A surface electrode is provided for applying current to the surface to enable measurements by the resistivity electrode 18. According to this example, a water bank 22 and an oil bank 24 are assumed to be separated by a sharp interface or "flood front" 26 which is located some distance "$r_f$" from the injection well 12. The saturation of water in the water bank is assumed to be 1-$S_{ro}$ and the saturation of water in the oil bank is assumed to be $S_{iw}$. If the effects of gravity and capillary forces are ignored, the governing equations for the pressure P (sensed by the pressure gauge 16) as a function of r (distance from the injector) and time t can be expressed as shown in equations 1 and 2 where Φ is the porosity of the layer, $C_w$ is the compressibility of water, $c_o$ is the compressibility of oil, $\lambda_{wb}$ is the fluid mobility in the water bank and $\lambda_{ob}$ is the fluid mobility in the oil bank.

$$\frac{\partial^2 P}{\partial r^2} + \frac{1}{r}\frac{\partial P}{\partial r} = \frac{\phi c_w}{\lambda_{wb}}\frac{\partial P}{\partial t} r < r_f \tag{1}$$

$$\frac{\partial^2 P}{\partial r^2} + \frac{1}{r}\frac{\partial P}{\partial r} = \frac{\phi c_o}{\lambda_{ob}}\frac{\partial P}{\partial t} r > r_f \tag{2}$$

Equation 1 holds true if the pressure gauge is in the water bank and Equation 2 holds true if the pressure gauge is in the oil bank. It will be appreciated that P must be continuous at the water front ($r=r_f$). Those skilled in the art will also appreciate that the fluid mobilities are determined by dividing permeability by viscosity. Generally, the permeability of a formation to water or oil is a function of water saturation.

While the pressure detected by the pressure gauge is influenced by the location of the flood front, the location of the flood front is influenced by the quantity of water injected. If q(t)is the instantaneous volumetric injection rate, the total quantity of water injected can be integrated from the time injection begins to as shown in equation 3.

$$Q(t) = \int_{t_0}^{t} q(t')\,dt' \tag{3}$$

If the compressibilities of water and oil are ignored, the radius of the flood front can be written as equation 4 where h is the thickness of the reservoir layer.

$$r_f(t) = \sqrt{\frac{Q(t)}{\pi\phi h(1 - S_{ro} - S_{iw})}} \tag{4}$$

Since the determination of pressure (equations 1 and 2) depends on the location of the flood front, equation 4 can be used to make that determination.

According to the invention, there are essentially two "unknown" parameters of interest: M (the ratio of mobility in the water bank to mobility in the oil bank) and $r_f(t)$ (the radius of the flood front at time t). It will be appreciated, however, that several parameters will be known before any of the pressure and resistivity measurements are made. These parameters include the geometry of the reservoir and surrounding areas which is known from well logs and seismic data. The porosity of the reservoir and the resistivity of the water and oil banks will also be known from well logs. The mobility in the water bank will be known from a well test in the injector.

Figure 2:
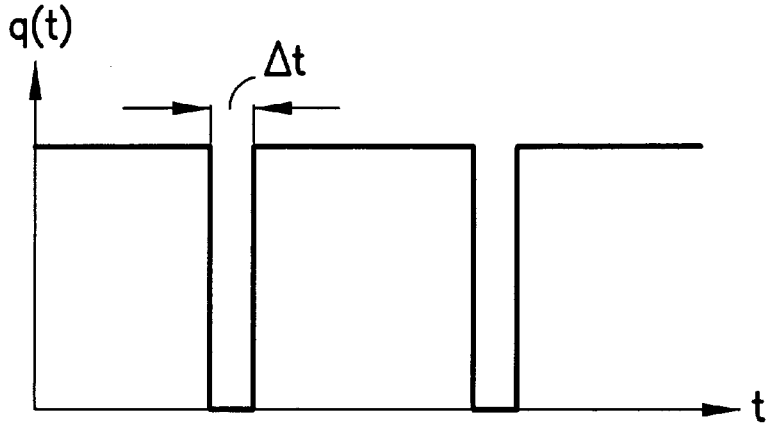
FIG. 2 is a simplified graph of flow rate against time illustrating the interruption of injection during fall-off tests.

According to the methods of the invention, pressure and resistivity measurements are used together with the previously known parameters about the reservoir in order to determine M and $r_f(t)$. According to a first method, which is applicable to a single-layer reservoir, resistivity and pressure measurements are acquired simultaneously during water injection and additional pressure measurements are taken during repeated "fall-off" tests. The fall-off tests involve periodically interrupting water injection. FIG. 2 illustrates the timing of fall-off tests in terms of quantity of water injected as a function of time. During repeated time intervals Δt, water injection is shut-in and kept off for a relatively brief period as compared to the time during which injection continues. The duration $\Delta t$ is chosen such that it can be assumed that the flood front remains stationary. During the time $\Delta t$ after shut-in, the pressure sensed by the pressure gauge (16 in FIG. 1) will decline. The magnitude of the pressure decrease will depend on a number of factors, some unknown, some known.

Figure 3:
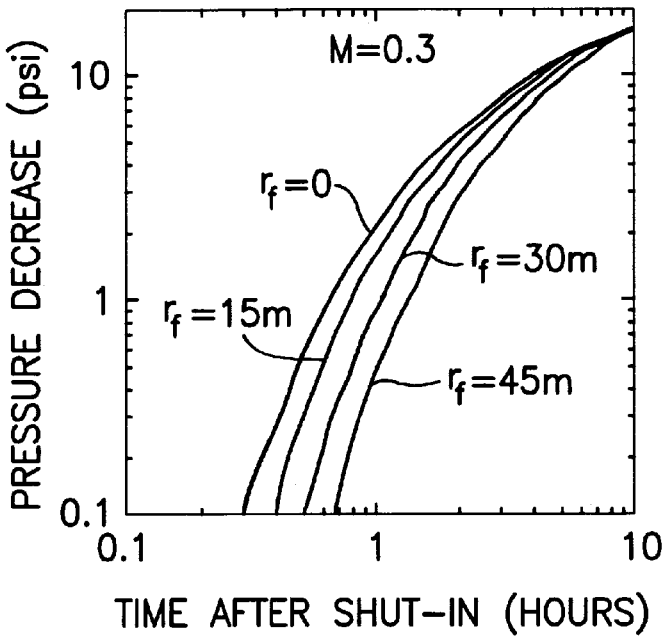
FIG. 3 illustrates exemplary plots of pressure against time during fall-off tests for several flood front radii, all based on a mobility ratio of 0.3.
Figure 4:
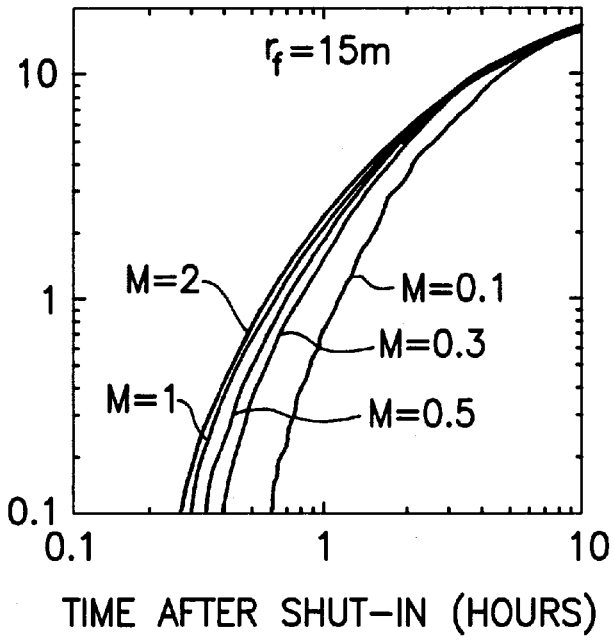
FIG. 4 illustrates exemplary plots of pressure against time during fall-off tests for several mobility ratios, all based on a flood front radius of 15 m.

FIG. 3 illustrates how pressure decreases after shut-in a fall-off test depending on the radius of the flood front; and FIG. 4 illustrates how pressure decreases after shut-in a fall-off test depending on the mobility ratio. Both FIGS. 3 and 4 were generated from a numerical reservoir simulator simulating a reservoir having a porosity of 20%, a thickness of 30 meters and a pressure gauge 60 meters from the injection well. As illustrated in FIGS. 3 and 4, the pressure drop detected from a single fall-off test cannot indicate the radius of the flood front unless the mobility ratio is known. Since the mobility ratio is constant for the reservoir and the radius of the flood front varies over time in proportion to the square root of the amount of water injected, one way of determining the mobility ratio is to make several fall-off measurements and compare the pressure drops to the amount of water injected. Another way, according to the first method of the invention, is to make a simultaneous resistivity measurement with the pressure measurement. The resistivity of the reservoir rock is sensitive to the radius of the flood front because the resistivity of water is much lower than the resistivity of oil.

Figure 5:
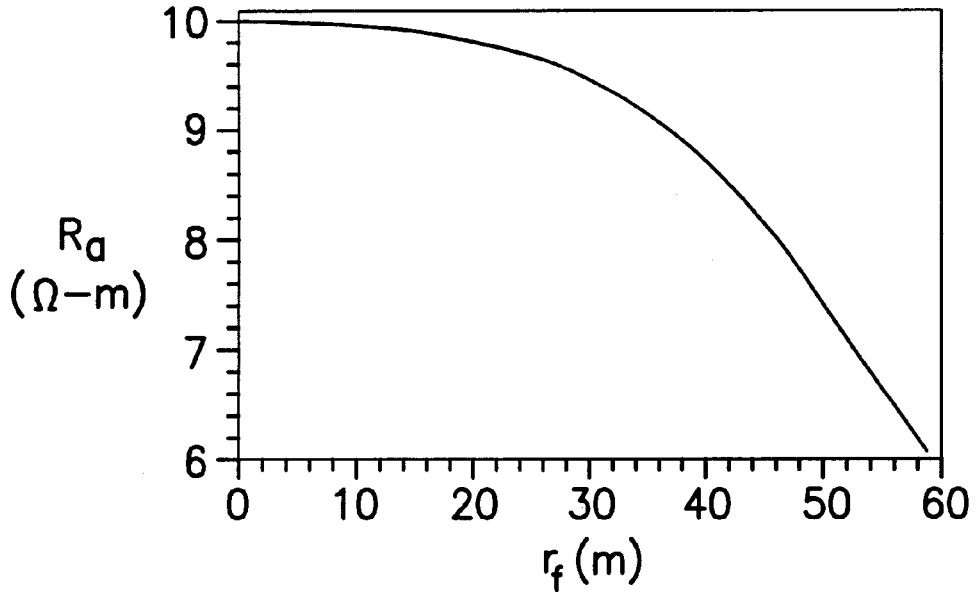
FIG. 5 is an exemplary plot of resistivity against flood front radius.

FIG. 5 illustrates how the apparent resistivity $R_a$ varies with the radius of the flood front $r_f$. The apparent resistivity shown in FIG. 5 was computed for a reservoir having a thickness of 30 meters, a resistivity sensor located 60 meters from the injection well, a water bank resistivity $R_{wb}$=0.5 Ω·m, and an oil bank resistivity $R_{ob}$=10 Ω·m. According to a simplified method of the invention, during a fall-off test, the flood front radius is obtained from a curve such as the one shown in FIG. 5 computed for known local characteristics (electrode positions, reservoir thickness, etc.). The flood front radius is then used to find the mobility ratio by matching the observed pressure drop during the fall-off test with the correct curve (FIG. 4) computed for known local characteristics (pressure gauge position, reservoir porosity and thickness, etc.). This simplified method implicitly assumes that the acquired data are accurate. In reality, resistivity and pressure measurements are likely to be contaminated by errors which will result in errors in the estimates of reservoir parameters. Also, reservoir characteristics (porosity, thickness, etc.) will not be known exactly.

According to a second method of the invention, multiple resistivity and pressure measurements are made over time and the data are combined to obtain the best estimates of reservoir parameters as well as an indication of the accuracy of the estimates. According to the invention, knowledge about each reservoir parameter is quantified with a probability density function (pdf) where the probability refers to how uncertain the knowledge of the parameter is. The pdf is a non-negative function where the probability of a parameter lying between two values equals the integral of the function in the interval spanned by the two values. Since the probability is a number between 0 and 1, the integral of the entire pdf is always equal to 1. At the start, prior to any measurements, the pdf for a reservoir parameter will describe a large initial uncertainty. For example, the prior pdf may be a constant with all possible values of the parameter having equal probability. As more measurements are acquired, the pdf for a reservoir parameter changes shape concentrating around the most probable value for the parameter.

Figure 6:
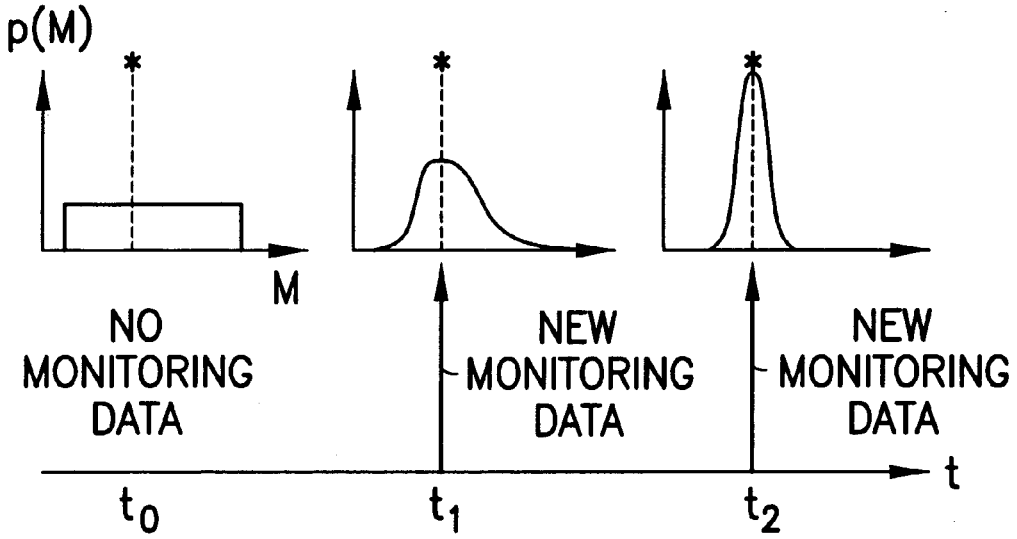
FIG. 6 is a schematic illustration of how a prior knowledge pdf is used to determine the accuracy of a reservoir parameter p(m) and how the uncertainty of p(m) decreases with more measurements.

FIG. 6 illustrates how the pdf for a reservoir parameter evolves over time. Values for the reservoir parameter M are listed along the x-axis and the probability p(M) of the value is listed along the y-axis. At time $t_0$, prior to making any measurements, all possible values of M have the same probability and the pdf is a constant. After some measurements have been made, at time $t_1$, the pdf shows a higher probability that * is the value of M. After many measurements have been taken, at time t2, the probability density is clearly weighted toward M=*.

The updating of the probability density function is preferably accomplished by application of Bayes' Theorem. Equation 5 illustrates how Bayes Theorem is applied by the present invention where:

x(t) is the vector of a reservoir parameter estimated at time d(t) is the vector of measurements made at time t, and I is the information available about the reservoir before measurements are made.

$$p(x(t)\mid d(t), I) = \frac{p(x(t)\mid I)p(d(t)\mid x(t), I)}{p(d(t)\mid I)} \tag{5}$$

According to Bayes' Theorem, the posterior pdf p(x(t)/d(t),I), the probability of the parameters x(t) at time t given the data acquired at time t and the prior information about the reservoir, is the product of the prior pdf p(x(t)/I), the probability of the parameters x(t) given the prior information, and the likelihood function p(d(t)/x(t),I), the probability of the data acquired given the parameter x(t) and the prior information, divided by p(d(t)/I), the probability of the data acquired given the prior information. However, since p(d(t)/I) does not depend on x(t), it acts as a normalizing constant and can be ignored.

The likelihood function can be written as equation 6, where g(x(t)) is a vector function that returns the value of the data that would be observed for given values of the parameters in x(t) at time t.

$$p(d(t)/x(t),I)=p(d(t)-g(x(t))) \tag{6}$$

Where d(t) are pressure data from a fall-off test, g(x(t)) is computed by running a reservoir simulator, for example. Where d(t) are resistivity data, g(x(t)) is computed by running a numerical calculation of the electrical potential. The vector function g(x(t)) describes the relationship between the data and the parameters. The pdf p(d(t)−g(x(t))) accounts for measurement errors.

Figure 7A:
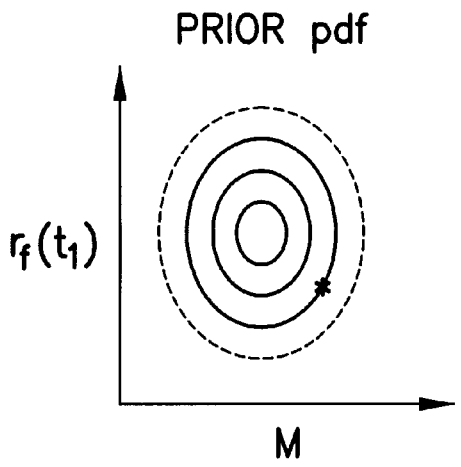
FIGS. 7*a*–7*d* schematically illustrate sequential steps in the Bayesian analysis of measurements according to the invention.
Figure 7B:
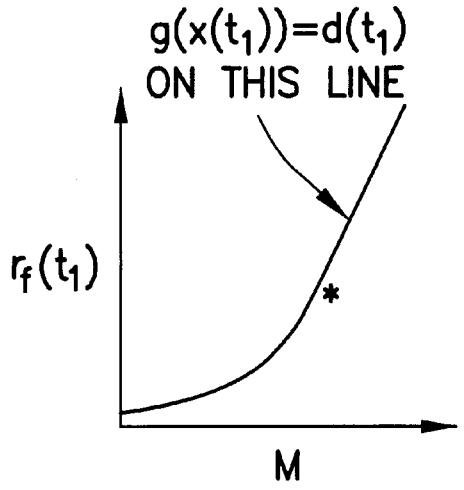
Figure 7C:
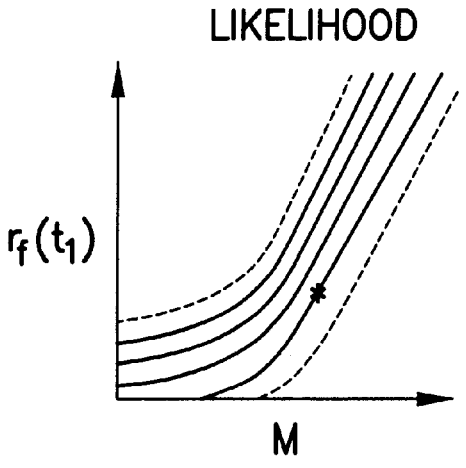
Figure 7D:
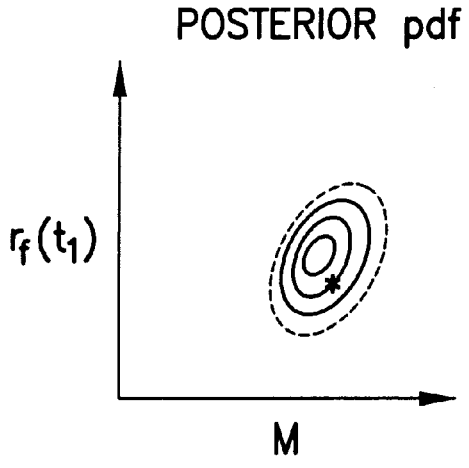

FIGS. 7*a*–7*d* illustrate the application of Bayes' Theorem in the estimation of $x(t_1)$=[M, $r_f(t_1)$] where the asterisk indicates the true value. FIG. 7*a* shows the prior pdf for $x(t_1)$ where it is known that the mobility ratio and radius of the flood front are unlikely to be outside a certain range. FIG. 7*a* shows a countour map of the prior pdf of flood front values and mobility ratio values where the dotted line indicates a very low probability (meaning that there is, say, 99% probability a priori of M and $r_f(t_1)$ having values within the dotted line). FIG. 7*b* illustrates a non-linear relationship between the flood front value and the mobility ratio where the data $d(t_1)$ acquired at $t_1$ is equal to the simulated data $g(x(t_1))$. FIG. 7*c* illustrates the likelihood function, equation 6, which shows how the function in FIG. 7*b* is modified to account for measurement errors. FIG. 7*d* illustrates the product of the prior pdf (FIG. 7*a* ) and the likelihood function (FIG. 7*c*), which is the posterior pdf absent the constant normalizing factor. Comparing FIGS. 7*a* and 7*d,* it can be seen that the posterior pdf provides a closer estimation of the true value of the flood front than the prior pdf.

According to the invention, Bayes' Theorem is applied repeatedly with each new data acquisition so that the posterior pdf shown in FIG. 7*d* becomes the prior pdf for then next data. In addition, however, the new prior pdf of the flood front radius is preferably updated based on the knowledge about the amount of water injected as per equation 4.

From the foregoing, it will be appreciated that as more data is acquired, the accuracy of the flood front radius estimates increases and the accuracy of the estimates can be known by the amount of data utilized in making the estimates. Furthermore, when the data is processed using Bayes' Theorem as described above, it is not necessary to obtain pressure and resistivity data simultaneously.

Figure 8:
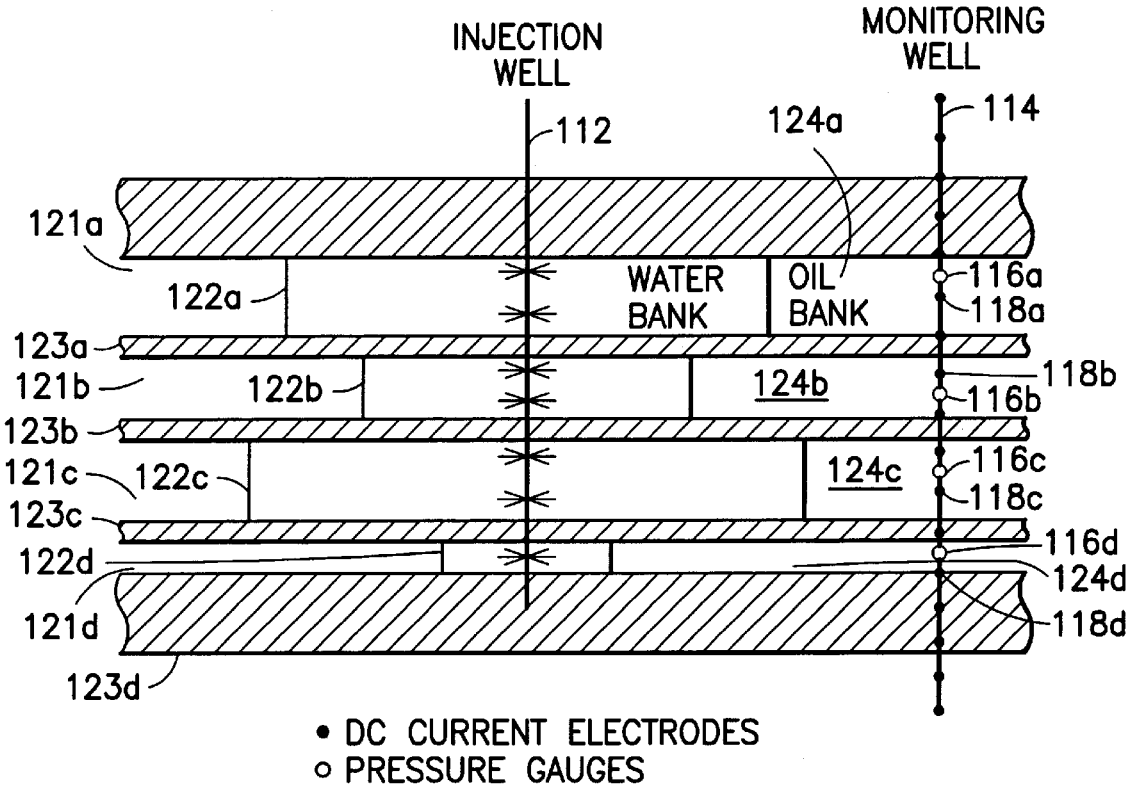
FIG. 8 is a schematic diagram of an injection well and a monitoring well in a multi-layer reservoir undergoing water injection.

The foregoing methods have been illustrated with reference to an oil reservoir having a single layer. Those skilled in the art will appreciate, however, that most reservoirs have multiple layers with different characteristics. FIG. 8, similar to FIG. 1 with similar reference numerals referring to similar elements, illustrates a reservoir having four different permeable layers (121*a*–121*d*) bounded by low permeability "baffle" layers (123*a*–123*d* ), each layer being transected by the injection well 112 and the monitoring well 114. Each layer has a water bank 122*a*–122*d* and an oil bank 124*a*–124*d*. As shown in FIG. 8, the monitoring well contains an array of DC electrodes 116*a*–116*d* and a plurality of pressure gauges 118*a*–118*d*. Preferably, a pressure gauge is located in each layer.

According to the invention, in a multiple layer reservoir, a vector x(t) is defined to contain a number of parameters for each layer. For example, the following parameters are defined for each layer:

- $\lambda_{wb}[i]$ is the fluid mobility in the water bank for the $i^{th}$ layer of the reservoir where i=1, 2, . . . , N;
- $\lambda_{ob}[i]$ is the fluid mobility in the oil bank for the $i^{th}$ layer of the reservoir where i=1, 2, . . . , N;
- $r_f[i](t)$ is the flood front radius at time t in the $i^{th}$ layer of the reservoir where i=1, 2, . . . , N; and
- $k_v[i]$ is the vertical permeability of the baffle layer between the ith layer and the (i+1)th layer of the reservoir where i=1, 2, . . . , N.

Those skilled in the art will appreciate that application of the analysis described above as the second method of the invention in an N layer reservoir will be computationally intensive. It will be necessary to compute the function g(x(t)) numerous times. It will also be appreciated that the resulting multi-dimensional pdf is difficult to visualize.

According to a third method of the invention, Bayesian data analysis in an N-layer reservoir is simplified by using Gaussian pdfs and by assuming that the locus of points where g(x(t))=d(t) can be locally approximated in the space of the parameters by a linear function. According to this approximation, the expected values and their covariances are sufficient to quantify the full form of the pdfs. The posterior expected value of x(t) is at the minimum of the function shown in equation 7 where T denotes the transpose, $C_d$ is the covariance matrix of the errors in the measurements, $C_{xo(t)}$ is the prior covariance matrix, and x0(t) is the vector of prior expected values of the parameters at time t.

$$F(x(t))=[g(x(t))-d(t)]^T C_d[g(x(t))-d(t)]+[x(t)-x_0(t)]^T C_{x_0(t)}[x(t)-x_0(t)] \quad (7)$$

According to the invention the function shown in equation 7 is minimized to find the posterior expected value of x(t) and the corresponding posterior covariance is then computed. These results are then used in equation 7 for the next set of data. Minimizing of equation 7 may be accomplished through iterative techniques based on the calculation of the gradient of the function in the space of the parameters, or by other known techniques. Those skilled in the art will appreciate that the posterior expected values and uncertainties of x(t) can be estimated in a variety of additional ways such as nonlinear optimization, Monte Carlo methods, etc.

The above description of the third method of the invention assumes that reservoir properties remain constant within each layer and that the injection well and the monitoring well are both vertical. In situations where the reservoir cannot be realistically approximated by a stack of layers as shown in FIG. 8, and/or where the wells are deviated or horizontal, appropriate vectors of parameters x(t) at different locations in the reservoir are defined and vector functions g(x(t)) which are appropriate for the geometry of the reservoir are computed.

In each of the methods described above, the sensing apparatus has been described as located in a monitoring well. According to the invention, the monitoring well may be the same well as the producing well or even the same well as the injection well. Regardless of which well is used, the sensing apparatus should be mounted outside the well casing, i.e. in contact with the formation. The casing of the well bearing the resistivity electrodes must be non-conductive or insulated on its outside face. If the resistivity electrodes are located in a well having a perforated casing (e.g. the injection well or the producing well), it is preferable that the interior surface of the casing be insulated. If the interior of the casing is not insulated, the magnitude of the electrical readings will be affected, but the interpretation of the readings need not be affected. However, currents flowing from the electrodes through perforations to the uninsulated inside face of the casing is likely to cause corrosion and chemical reactions in the casing. These reactions could change the casing conductivity and thus affect the electrical readings in a way which would hamper interpretation. Therefore, it is preferred that at least the perforated portion of the casing be made of non-conductive material such as high strength composite material.

As mentioned above with reference to the first method of the invention, measurement of injected water volume is useful to constrain the estimate of the flood front radius. According to the invention, such water quantity measurements can also be used in conjunction with the second and third methods of the invention. The relationship between quantity of water injected and flood front radius is influenced by reservoir thickness and porosity, the initial oil saturation, and the initial water saturation. If initial knowledge of these parameters is quantified as a prior pdf, this information can be combined with measurements over time of quantity of water injected to obtain a prior pdf of the flood front radius which can be used as part of the methods and procedures described above.

Further, according to the invention, while it is preferred that pressure measurements and water volume measurements be made in situ, it is possible to make these measurements on the surface and to correct for the effects of formation damage, etc.

Figure 9:
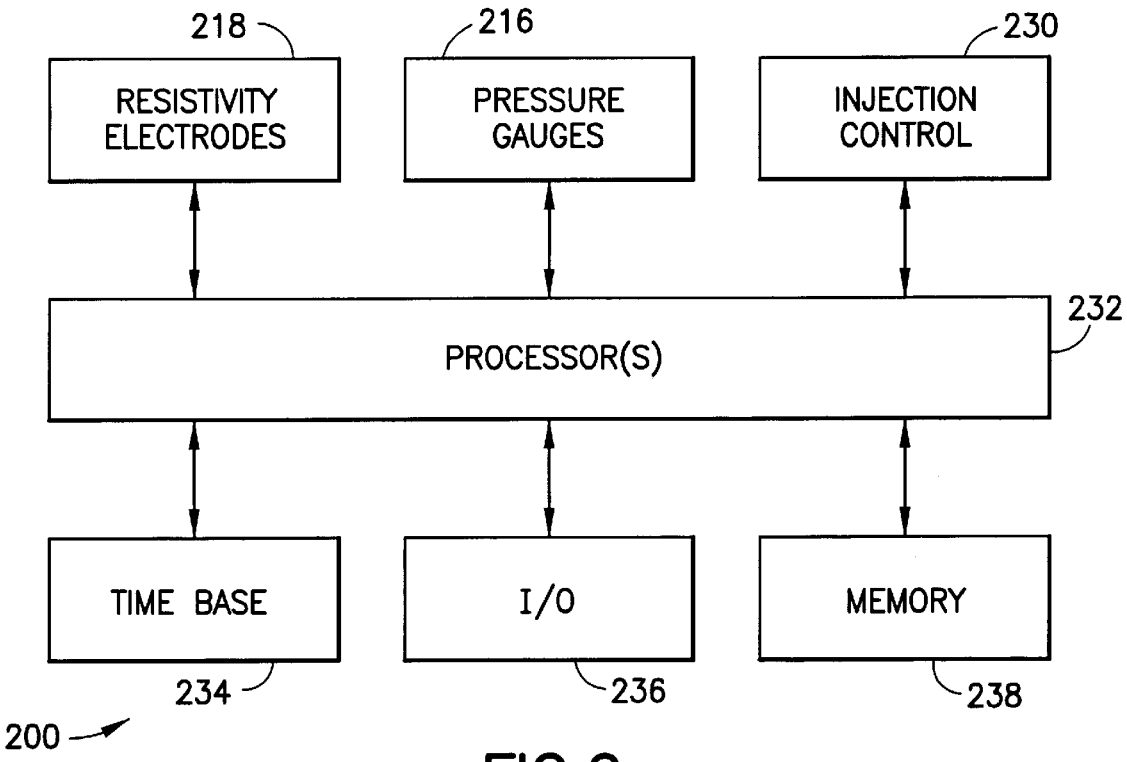
FIG. 9 is a block diagram of an apparatus suitable for implementing the methods of the invention.

From the foregoing, those skilled in the art will appreciate that the methods of the invention may be implemented with the aid of a general purpose data/signal processor(s). FIG. 9 illustrates one example of the type of apparatus useful in practicing the methods described above. The apparatus 200 includes the aforementioned pressure gauges 216 and resistivity electrodes 218 as well as an apparatus 230 for controlling the water injection well as described above. These sensors and controller are coupled to a general purpose or special purpose processor or processors 232. The processor (s) 232 may be a microprocessor, a signal processor, or an ASIC (application specific integrated circuit), or a combination of these. The processor(s) 232 is (are) preferably coupled to a time base 234, input/output devices 236, and non-volatile memory 238. The time base 234 is used for measuring the fall-off test times and for other processing tasks requiring time data. The I/O 236 is used to input data regarding known reservoir parameters and to select the type of processing desired (i.e., which of the methods described above will be used) and to output the results of data analysis. The memory 238 is used to store program information (if the programs are not hard coded into the processor circuitry) as well as data There have been described and illustrated herein several embodiments of methods and apparatus for dynamically estimating the location of an oil-water interface in a producing petroleum reservoir. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A method of locating an oil-water interface in a petroleum reservoir having an oil bank, comprising:

a) measuring resistivity in the reservoir or at a location where resistivity is measurably affected by the location of the oil-water interface;

b) injecting water into the reservoir for a period of time;

c) interrupting water injection;

d) measuring pressure in the reservoir or at a location where pressure is measurably affected by the location of the oil-water interface; and e) analyzing the resistivity measurement and the measured drop in pressure to determine the location of the oil-water interface.

2. A method according to claim 1, further comprising:

f) periodically interrupting water injection;

g) periodically measuring pressure during water injection interruptions; and h) periodically analyzing the periodic pressure measurements to determine the moving location of the oil-water interface.

3. A method according to claim 1, further comprising:

f) measuring the quantity of water injected prior to interrupting water injection.

4. A method according to claim 2, further comprising:

i) measuring the cumulative quantity of water injected prior to each pressure measurement.

5. A method according to claim 2, further comprising:

i) measuring pressure and resistivity substantially simultaneously during water injection interruptions.

6. A method according to claim 1, further comprising:

f) measuring pressure and resistivity at a variety of times while water is being injected.

7. A method according to claim 6, further comprising:

g) prior to measuring pressure and resistivity, quantifying prior knowledge about reservoir parameters as a prior probability density function; and h) combining the prior probability density function with first measurement results to obtain a first posterior probability density function.

8. A method according to claim 7, further comprising:

i) combining the first posterior probability density function as a prior probability density function with second measurement results to obtain a second posterior probability density function; and j) iteratively repeating step "i)" for subsequent measurement results.

9. A method according to claim 6, further comprising:

g) prior to measuring pressure and resistivity, quantifying prior knowledge about reservoir parameters as a Gaussian probability density function; and h) combining the Gaussian probability density function with first measurement results to obtain a first posterior covariance matrix.

10. A method according to claim 9, further comprising:

i) combining the first posterior covariance matrix with second measurement results to obtain a second posterior covariance matrix; and j) iteratively repeating step "i)" for subsequent measurement results.

11. An apparatus for locating an oil-water interface in a petroleum reservoir having an oil bank, comprising:

a) injection means for injecting water into the reservoir;

b) first measuring means for measuring resistivity in the reservoir or at a location where resistivity is measurably affected by the location of the oil-water interface;

c) second measuring means for measuring pressure in the reservoir or at a location where pressure is measurably affected by the location of the oil-water interface; and d) processor means coupled to said first and second measuring means for analyzing resistivity measured by said first measuring means and pressure measured by said second measuring means to determine the location of the oil-water interface.

12. An apparatus according to claim 11, further comprising:

e) control means coupled to said injection means and coupled to said processing means for interrupting water injection, wherein said processing means causes said control means to interrupt water injection and causes said second measuring means to measure pressure drop while water injection is interrupted.

13. An apparatus according to claim 12, wherein:

said processing means causes said control means to interrupt water injection periodically and causes said second measuring means to measure pressure drop during the periodic interruptions of water injection, and said processing means periodically analyzes the periodic pressure measurements to determine the moving location of the oil-water interface.

14. An apparatus according to claim 13, wherein:

said processing means causes said first and second measuring means to measure resistivity and pressure substantially simultaneously during water injection interruptions.

15. An apparatus according to claim 14, wherein:

said processing means causes said first and second measuring means to measure resistivity and pressure at a variety of times while water is being injected.

16. An apparatus according to claim 15, further comprising:

f) input means coupled to said processing means for inputting prior knowledge about reservoir parameters, wherein said processing means includes means for quantifying the prior knowledge about reservoir parameters as a prior probability density function, and said processing means includes means for combining the prior probability density function with first measurement results to obtain a first posterior probability density function.

17. An apparatus according to claim 16, wherein:

said processing means includes means for combining the first posterior probability density function as a prior probability density function with second measurement results to obtain a second posterior probability density function, and said processing means includes means for iteratively combining posterior probability density functions with subsequent measurement results.

18. An apparatus according to claim 15, further comprising:

f) input means coupled to said processing means for inputting prior knowledge about reservoir parameters, wherein said processing means includes means for quantifying the prior knowledge about reservoir parameters as a Gaussian probability density function, and said processing means includes means for combining the Gaussian probability density function with first measurement results to obtain a first posterior covariance matrix.

19. An apparatus according to claim 18, wherein:

said processing means includes means for combining the first posterior covariance matrix with second measurement results to obtain a second posterior covariance matrix, and said processing means includes means for iteratively combining posterior covariance matrices with subsequent measurement results.

* * * * *